United States Patent [19]

Isom

[11] Patent Number: 4,997,048

[45] Date of Patent: Mar. 5, 1991

[54] DRILL PIPE ASSEMBLIES

[76] Inventor: John R. Isom, 7251 Poppy Way, Golden, Colo. 80403

[21] Appl. No.: 520,259

[22] Filed: May 7, 1990

Related U.S. Application Data

[63] Continuation-in-part of Ser. No. 397,846, Aug. 24, 1989, Pat. No. 4,949,797.

[51] Int. Cl.[5] ..... E21B 17/02; E21B 17/18; E21B 17/22

[52] U.S. Cl. ..... 175/323; 175/317; 166/65.1; 166/57; 285/133.1; 285/138; 285/333

[58] Field of Search ..... 175/320, 321, 323, 215, 175/317; 166/65.1, 57, 350, 242; 285/133.1, 138, 333; 174/47, 75 C

[56] References Cited

U.S. PATENT DOCUMENTS

| | | | |
|---|---|---|---|
| 1,024,310 | 4/1912 | Canfield . | |
| 1,628,033 | 5/1927 | Davis . | |
| 1,746,132 | 2/1930 | Stokes . | |
| 2,494,803 | 1/1950 | Frost et al. | 138/87 |
| 2,610,028 | 9/1952 | Smith | 285/333 |
| 2,999,552 | 9/1961 | Fox | 285/333 |
| 3,065,807 | 11/1962 | Wells | 175/321 |
| 3,265,091 | 8/1966 | De Jarnett | 138/114 |
| 3,489,438 | 1/1970 | McClure | 285/133 |
| 3,638,970 | 2/1972 | Sandquist et al. | 285/24 |
| 3,879,097 | 4/1975 | Oertle | 339/16 R |
| 3,928,903 | 12/1975 | Richardson et al. | 29/407 |
| 4,067,596 | 1/1978 | Kellner et al. | 285/133 |
| 4,149,739 | 4/1979 | Morris | 285/133.1 |
| 4,280,535 | 7/1981 | Willis | 138/112 |
| 4,423,778 | 1/1984 | Goldsmith | 166/134 |
| 4,560,012 | 12/1985 | McNeely, Jr. | 175/61 |
| 4,683,944 | 8/1987 | Curlett | 166/65.1 |

*Primary Examiner*—Stephen J. Novosad

*Attorney, Agent, or Firm*—Laney, Dougherty, Hessin & Beavers

[57] ABSTRACT

An improved drill pipe assembly that is formed as a concentric walled pipe having both an axial and an annular space therethrough, and the pipe section includes means for selectively communicating the adjoining annular spaces through the series of respective box end/pin end joints whereby equipment compartmentation, conductor traverse, ballast containment, gas pressurization and weight addition can be effectively utilized in controlled manner. The pipe is assembled by threaded engagement of the pin end joint to each of an outer pipe and an inner pipe, and subsequent threaded joinder of the concentric pipes to a box end joint while also utilizing an intermediate double-threaded sleeve between the inner pipe threads and the box end collar threads.

16 Claims, 5 Drawing Sheets

DRILL PIPE ASSEMBLIES

CROSS-REFERENCE TO RELATED APPLICATIONS

This application is a continuation-in-part of U.S. Pat. application Ser. No. 07/397,846 filed Aug. 24, 1989, entitled "Improvements in Drill Pipe", now U.S. Pat. No. 4,949,797.

BACKGROUND OF THE INVENTION

1. Field of the Invention

The present invention relates generally to a form of concentric tube drill pipe assembly and, more particularly, but not by way of limitation, it relates to improved drill pipe that enables wide variance in weight and buoyancy while containing space for continuous communication and electronic modules, such drill pipe being particularly adaptable for extended horizontal or deviated drilling applications.

2. Description of the Prior Art

Dual tube concentric drill pipe has been known for a long number of years as it has been utilized for obtaining various advantages in the drilling operation. An early U.S. Pat. No. 1,024,310 proposed a concentric drill pipe intended for boring shallow oil or artesian wells with reduced danger of blocking the hole as might be caused by breaking of the drill bit downhole. A U.S. Pat. No. 1,746,132 taught a concentric drill pipe wherein an annulus portion forms a sealed chamber for air or other gas which serves to lessen the weight of the drill stem.

A U.S. Pat. No. 3,928,903 teaches a specific form of construction for concentric drill pipe using only threaded interconnector means in the assembly. U.S. Pat. No. 4,280,535 teaches yet another form of concentric drill pipe that utilizes a more basic approach wherein a conventional form of drill pipe contains a smaller diameter pipe extending axially therethrough while being concentrically spaced by a number of spacer lugs. Finally, U.S. Pat. No. 3,265,091 is of interest for its teaching of concentric drill pipe that provides an annular space for carrying fluid or other material for the purpose of damping vibrations set up during drilling activity.

U.S. Pat. No. 4,560,012 in the name of McNeely provides teaching of a drill collar having inner and outer pipes with threaded pin and box ends securely affixed to the outer pipe. The inner pipe is aligned by abutment with an axial bore in the pin and box end joints, and the annular space is filled with a suitable foam plastic of selected specific gravity. This device is intended to function as a drill collar that has sufficient rigidity but lighter weight so that it is suitable for high angle deviation drilling or the like. This patent teaches mere capping or abutment of the inner tube with the opposite threaded inserts, a type of joinder that would not provide sufficient sealing capability.

SUMMARY OF THE INVENTION

The present invention relates to improvements in concentric drill pipe wherein the annular space is capable of several different functions while also providing conduit and housing for electronics and interconnection. The inner pipe is threadedly secured between the box end and pin end of the concentric pipe assembly and passages are provided for intercommunication between the annular spaces of adjacent drill pipe assemblies. In addition, an interconnecting cable may be continuously aligned through the series of drill pipe assemblies as a make-up space is provided beneath the box end thread to provide a length of cable sufficient to allow for differential rotation of adjoining pipe assemblies during make up.

An alternative structure provides inner and outer tubes that are securely threaded at each end to the respective box end and pin end joints. Thus, the pin end joint threadedly receives both the outer tube and the inner tube in very tight, secure manner to define the annular space. The box end joint receives the outer tube securely threaded thereto while the inner tube is securely threaded by virtue of an additional double-threaded sleeve, i.e., both the inside and outside sleeve surfaces, which is adjusted to remove any slack thread play upon assembly thereby to provide a tight, threaded engagement. The annular space is maintained by at least one suitable equalizer that limits flexure and therefore variations in the annular space radial dimension.

Therefore, it is an object of the present invention to provide a drill pipe assembly that is particularly useful for long distance horizontal and deviated well drilling.

It is also an object of the invention to provide a drill pipe assembly capable of permitting continuous electrical connection along a drill string.

It is still further an object of the present invention to provide a drill pipe assembly that allows greater range of adjustment for weight and buoyancy thereby to increase likelihood of the drill string remaining in continuous operation for longer periods of time.

Finally, it is an object of the present invention to provide a drill pipe assembly having improved operational capability in horizontal and deviation drilling applications.

Other objects and advantages of the invention will be evident from the following detailed description when read in conjunction with the accompanying drawings which illustrate the invention.

DETAILED DESCRIPTION OF THE INVENTION

Figure 1:
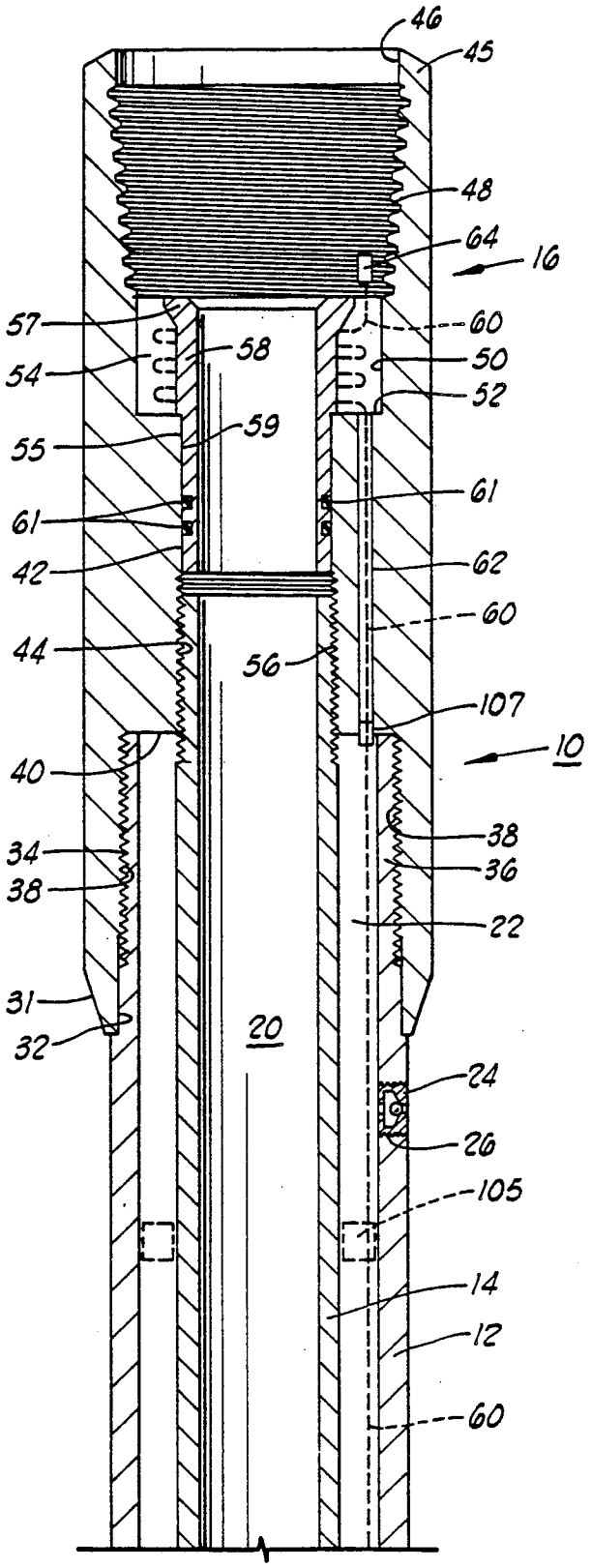
FIG. 1 is a view in cross-section of the box end portion of a drill pipe assembly.
Figure 2:
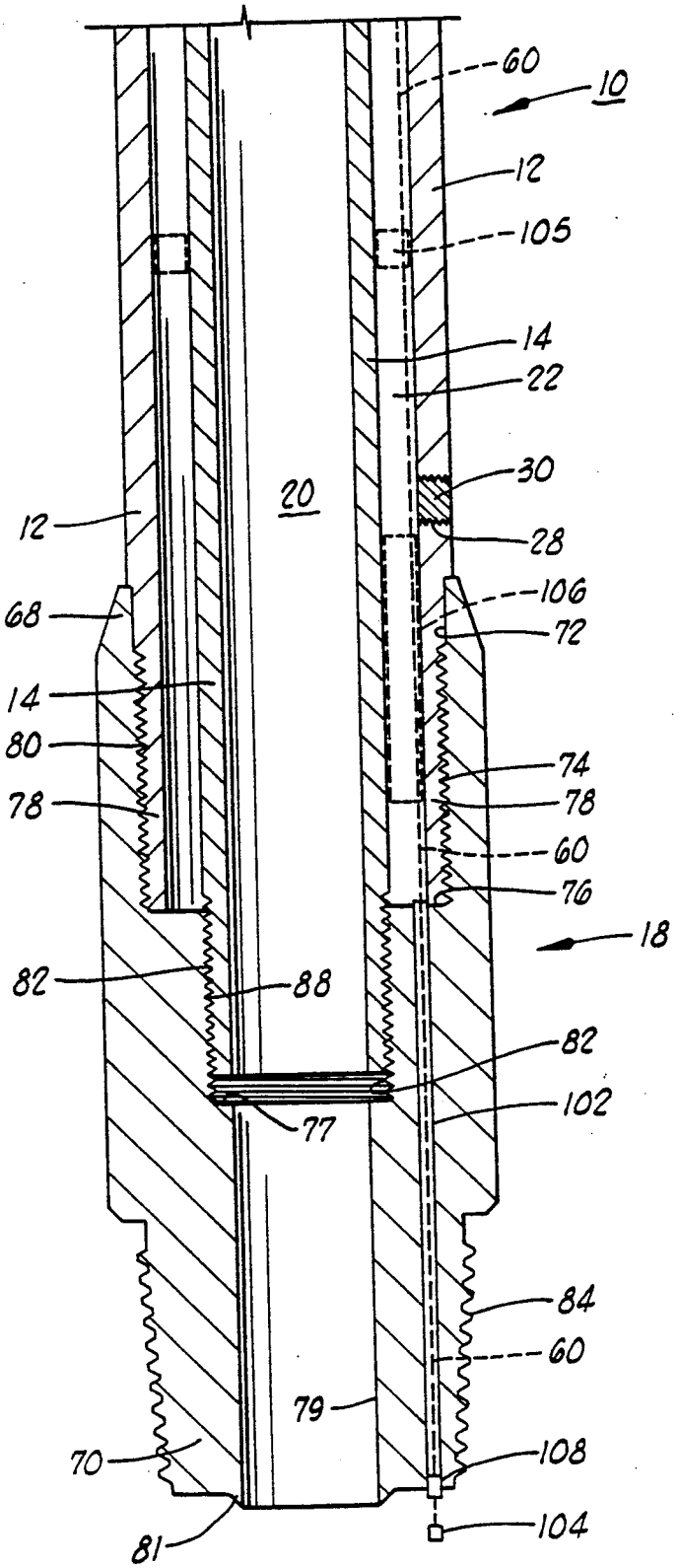
FIG. 2 is a vertical cross-section of the pin end portion of the drill pipe assembly.

Referring to FIGS. 1 and 2, a drill pipe assembly 10 consists of an outer pipe 12 and a concentric, inner pipe 14 as secured at one end to a box end tool joint 16 and at the other end to a pin end tool joint 18. The outer pipe 12 may be a conventional drill pipe having requisite inner and outer diameter measurements, and the inner pipe 14 is selected to provide a sufficient balance as between the cross-sectional area of an inner bore 20 and an annular space 22. Access for entry of fluids and gas under pressure is provided by a check valve 24 threadedly received through the outer pipe 12 by means of threaded bore 26. Also, a threaded bore 28 sealed by threaded plug 30 provides access for entry of solids such as lead shot or other weighting medium.

Referring to FIG. 1, the end 31 of box end joint 16 has an axial bore 32 formed with internal threads 34 for receiving securely therein an upper end 36 of outer pipe 12 having threads 38. The bore 32 extends sufficiently within box end joint 16 to assure seal-tight threaded insertion while terminating in an annular shoulder 40 and a second axial bore 42, a smooth bore having an inner part formed as a threaded collar 44.

The opposite end 45 of box end joint 16 is formed with an axial bore 46 and the conventional form of tapered coupling threads 48 for receiving a pin end connection. The inner end of taper threads 48 is then formed into a bore 50 terminating in annular shoulder 52 and defining a sufficient cylindrical space 54 that is suitable for formation of a cable coiling space, as will be further described.

The inner pipe 14 may then be inserted and joined concentrically by engagement of threads 56 through the threaded collar 44 portion within bore 42. A cylindrical insert 55 having outer seating flange 57 and smooth barrel 59 is inserted within the smooth bore 42. Plural groove-seated O-rings 61 around barrel 59 provide tight, sealed seating of insert 55. The upper end pipe portion 58 with flange 57 protrudes into the cylindrical volume 54 in position for mating engagement with a pin end nipple formation, as will be described. A wire or multi-conductor cable 60 of selected size and type is then threaded around volume 54 and downward through a circular passage 62 to extend the length of the annular space 22. A suitable quick-release receptacle 64 is coupled on the end of cable 60 and sufficient coils of cable are reserved around upper end 58 of inner pipe 14 to allow for sufficient rotation of the pipe assemblies during make up of a tool joint.

Referring to FIG. 2, the pin end joint member 18 has opposite ends 68 and 70 for affixure over the opposite end of outer pipe 12 and inner pipe 14. The end 68 includes an axial bore 72 which includes threads 74 that terminate in an annular shoulder 76. An end 78 of outer pipe 12 includes threads 80 and is adapted to be sealingly received within threads 74 of axial bore 72.

A further threaded bore 82 is formed to extend axially from annular shoulder 76 down to a shoulder 77 leading into a smooth bore 79. The inner tube 14 has lower threads 88 for mating engagement within threaded bore 82. Pin end 70 is formed with taper threads 84 for mating engagement with a box end connector. The outer end of bore 79 is formed as a conical surface lip 81 for mating abutment with flange 57 (FIG. 1) when the joint is made-up.

A suitable circular bore or passage 102 is formed from annular shoulder 76 through the pin end 70 to receive cable 60 therethrough whereupon a suitable quick-release connector 104 is attached. The connector 104 is adapted for secure connection to a mating receptacle such as receptacle 64 at the opposite end of a pipe assembly. Suitable electronics modules such as shown in dash-line 106 may be located in the annular space 22 and retained in safe, insulated positioning, and such electronics modules may be connected into the multi-conductor circuit provided by cable 60. One or more centralizing spacers or equalizers 105 may be utilized to maintain concentricity of inner tube 14.

In assembly of the pipe assembly 10, the outer tube 12 and inner tube 14 may first be threadedly engaged within the box end member 16 with subsequent threading of cable 60 through bore 62 and placement of sealing plugs (or valves) 24 and 30. The pin end member 18 may then be threadedly engaged with threads 74 on threads 80, and simultaneous engagement of threads 82 on inner pipe threads 88 until the entire assembly is rigidly secured.

In operation, when making up a tool joint between two pipe assemblies 10, the pin end member 18 and nipple tube 94 will be lowered into the box end member 16. A sufficient number of turns of cable 60 will have been layed around inner tube end 58 in counter rotating relationship, and receptacle 64 will have been engaged with the connector 104 of the succeeding pin end position. The pin end member 18 is then rotated a sufficient number of turns to securely engage threads 84 within threads 48 for continuation of drilling activity. A suitable spring clip or other retention member may be employed within the cylindrical volume 54 to insure that cable 60 and the connectors do not get caught or crushed by the mating pipe members.

Prior to connection of the drill pipe assemblies 10 into the drill string, the annular spaces 22 in each assembly will have been charged with material to aid in the drilling process. When drilling in a horizontal or near horizontal attitude it may be desirable to pump air under pressure through check valve 24 thereby to increase the rigidity of the pipe string within the well fluids. In other applications, and certain deviated directional operations, it may be desirable to vary the weight condition of annular space 22 by either introduction of a fluid or gas through check valve 24 or placement of lead shot or some other weighting material through the plug 30. Introduction of nitrogen under pressure can be done for insulation effect in geothermal well-drilling, and a gas at high pressure can serve to strengthen the drill pipe for compressive use. The filling part of the operation can be attended to before the individual pipe assemblies are taken to the rig floor for positioning in the string. Suitable feed-through sealing plugs 107, 108 may be used to seal the passages 62 and 102 to ensure pressure isolation of annular space 22.

Figure 3:
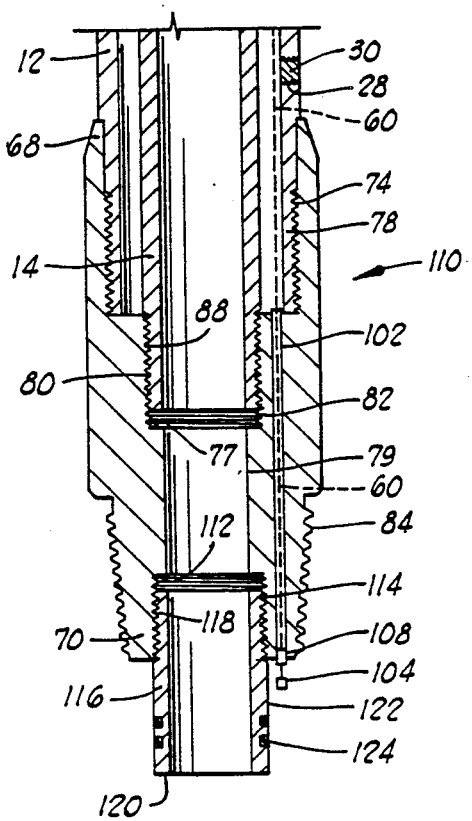
FIG. 3 is a view in cross-section of an alternative form of pin end pipe construction.

FIG. 3 represents an alternative form of pin end tool joint 110 that may be used with the box end tool joint 16 after the cylindrical insert 55 has been removed. Thus, the lower portion of bore 79 is formed with a counterbore defining annular shoulder 112 and internal threaded bore 114. All of the remaining structure is identical to the pin end tool joint 18 of FIG. 2.

Tool joint 110 includes a cylinder 116 having threads 118 around on end for threaded insertion in engagement with internal threads 114. The opposite end of cylinder 116 then protrudes axially from pin end 70 to a terminus 120 that is diametrically sized for close insertion within smooth bore 42 (FIG. 1) of a box end joint 16. One or more circumferal grooves 122 with seated O-rings 124 provides sealing affixure when the box end/pin end joint is made-up with cylinder 116 slid into smooth bore 42.

Figure 4:
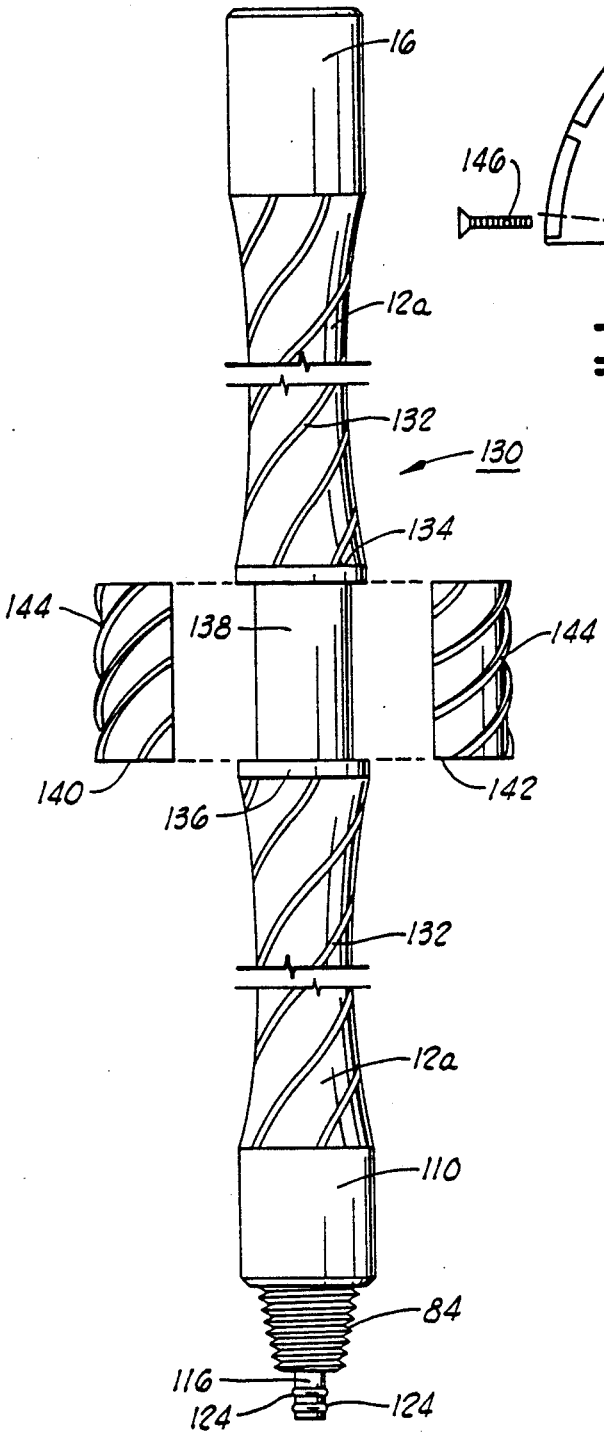
FIG. 4 is a plan view of a drill pipe assembly constructed in accordance with the present invention and shown with central parts exploded therefrom.

FIG. 4 illustrates a pipe assembly 130 that is particularly useful in horizontal and deviated directional drilling operations. Thus, the outer pipe **12*a* is formed with an elongated spiral groove or pattern of grooves 132 which lessens the probability of sticking during rotation. The groove structure tends to break up surface tension and cause a clearing activity along the length of pipe assembly 130. Still further, the pipe 12***a* may include the formation of upset collars 134 and 136, spaced by about two feet, and defining a cylindrical surface 138 therebetween. A pair of semi-cylindrical shoes 140 and 142 may then be bolted in cylindrical surface 138 by suitable recessed fasteners. The shoes 140 and 142 each carry a series of spiral paddles or vanes 144 formed on the outer diameter.

Figure 5:
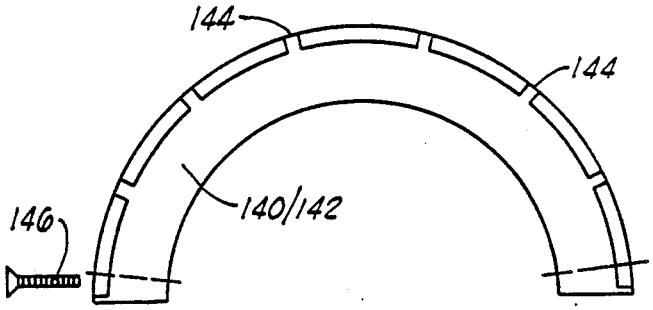
FIG. 5 is an end view shown in elevation of a semicylindrical contact shoe as shown in FIG. 4.

FIG. 5 illustrates an end view of a semi-cylindrical shoe 140/142 and its vane structure 144. With such as the vane structure or turbulator 144 disposed generally centrally of outer pipe 12*a*, there tends to be a spiral paddling effect that aids in maintaining movement of outcoming drilling fluid and particles. The shoes 140/142 may be secured about surface 138 by means of a plurality of recessed fasteners such as bolt 146. In a preferred form the turbulator 144 is molded of urethane in one piece as the two halves 140/142 are joined along one common edge. The turbulator 144 can then be sufficiently flexed to allow positioning and bonding about the mid-portion of the outer pipe.

Figure 6:
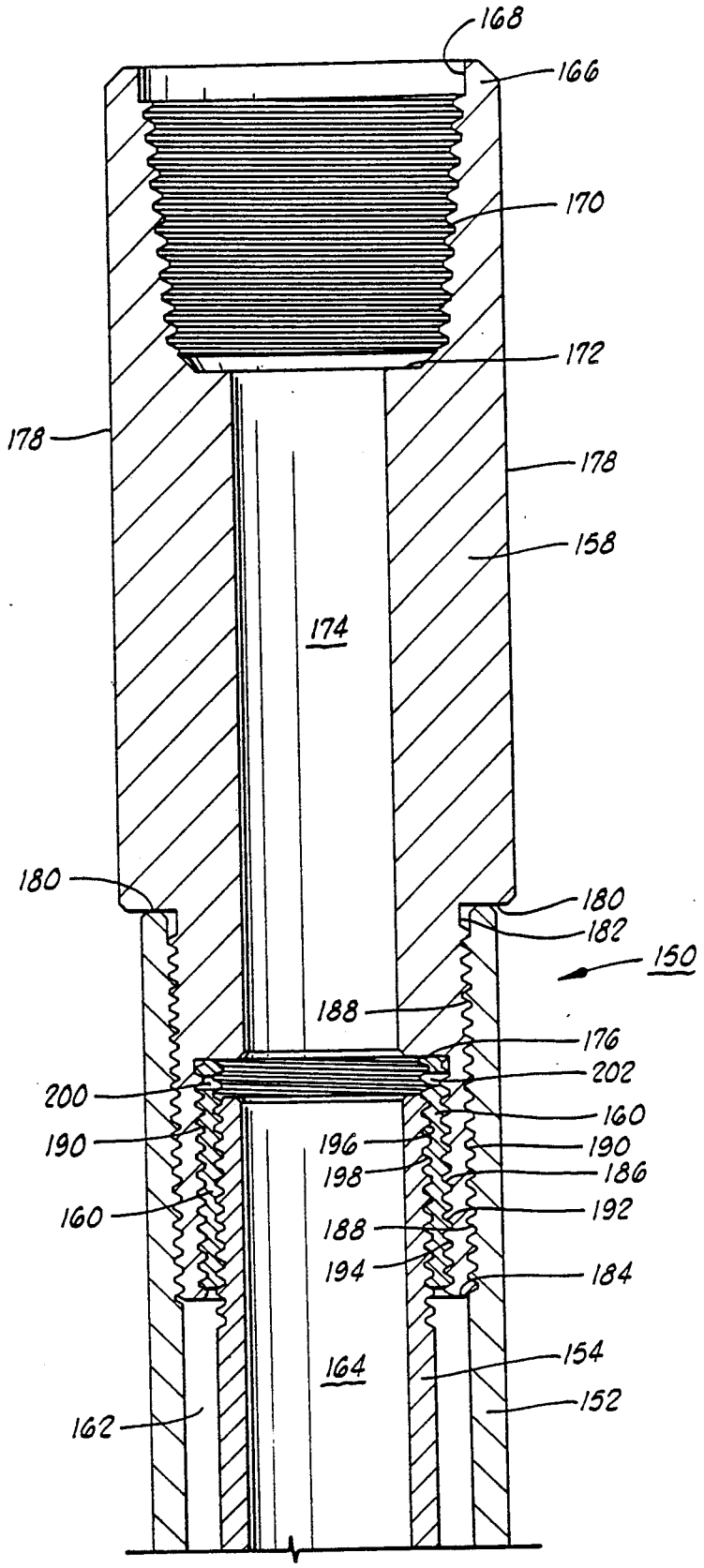
FIG. 6 is a view in vertical section of the box end portion of an alternative form of drill pipe assembly.
Figure 7:
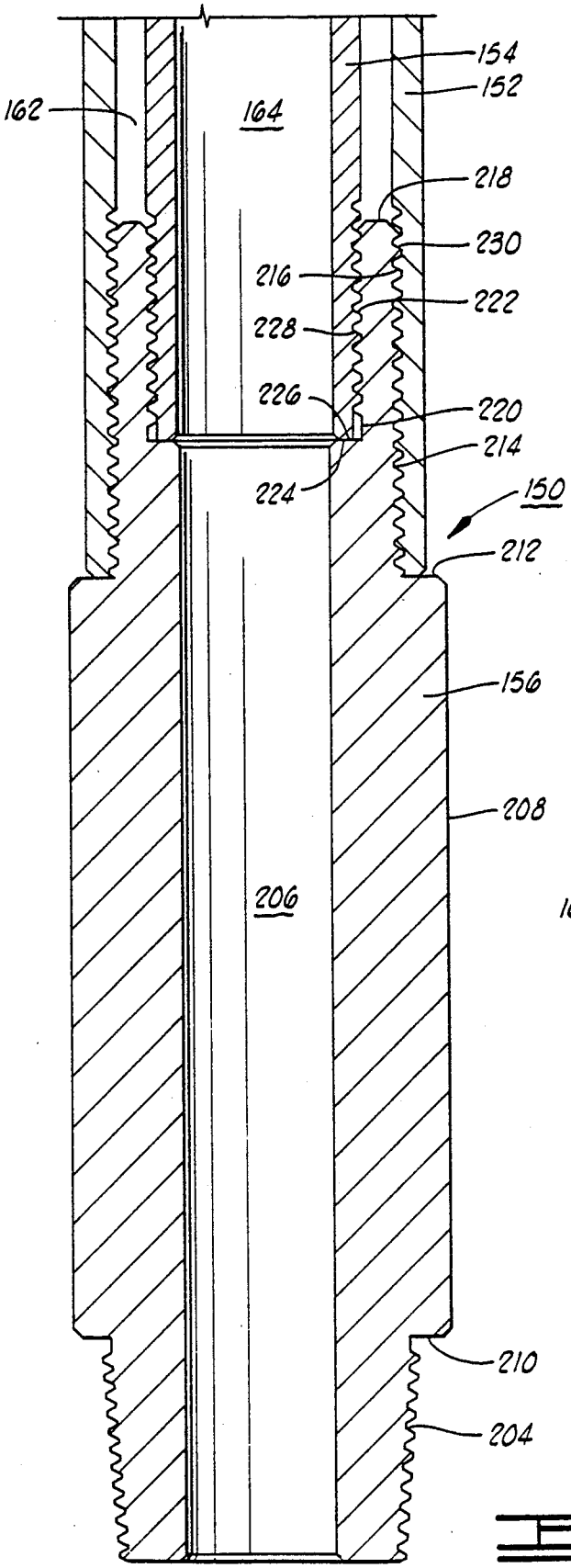
FIG. 7 is a view in vertical section of the pin end portion of the alternative drill pipe assembly.

Referring now to FIGS. 6 and 7, an alternative form drill pipe assembly 150 consists of an outer pipe 152 and a concentric, inner pipe 154. The inner pipe 154 and outer pipe 152 are secured at one end (FIG. 7) to a pin end tool joint 156, and at the other end (FIG. 6) to a box end tool joint 158 as aided by a threaded sleeve 160. The concentric inner pipe 154 and outer pipe 152 define an annular space 162, and inner pipe 154 defines an axial bore 164.

Referring to FIG. 6, the box end joint 158 has formed at its upper end 166 an axial bore 168 and conventional tapered coupling threads 170 that terminate at an upward facing annular shoulder 172. The shoulder 172 then extends into an axial bore 174 through the length of box end joint 158 to terminate at a downwardly facing annular shoulder 176. The axial bore 174 defines the drill pipe assembly internal flow way, and it is formed to be of the same diameter as axial bore 164 of inner pipe 154.

The box end joint 158 is formed with an outer cylindrical surface 178 that extends into a downwardly facing annular shoulder 180 that terminates in a concentric surface 182 having external thread 188 that extends downward to a terminus 184. A threaded bore 186 then extends upward within surface 182 to terminate at annular shoulder 176. Surface 42 has external threads 188 formed along its length for mating engagement with internal threads 190 of outer pipe 152. The bore 186 includes continuous threads 192 for mating engagement with threads 194 along the length of sleeve 160, and internal threads 196 of sleeve 160 are aligned for mating engagement with external threads 198 of inner pipe 154. Oppositely disposed ¼-inch diameter holes 200 and 202 are formed through the upper end of sleeve 160 for the purpose of retaining an expansible wrench lug, as will be further described below.

Referring now to FIG. 7, the pin end joint 156 is formed at the lower end with tapered threads 204 for mating engagement with a set of box end threads 170 (FIG. 6). The pin end joint 156 defines a uniform diameter axial bore 206 that is continuous with inner pipe bore 164 upon assembly. A cylindrical outer surface 208 extends into a downwardly facing annular shoulder 210 which, in turn, forms into the interconnecting threads 204. The upper end of surface 208 forms into an upwardly facing annular shoulder 212 which then extends into a collar surface 214 having external threads 216. The collar surface 214 extends to an annular terminus 218 and forms into axial counterbore 220 having internal threads 222. The counterbore 220 then forms into an upwardly facing annular shoulder 224 adjacent the axial bore 206, the shoulder 224 serving to abut the annular terminus 226 of inner pipe 154. The inner pipe 154 has external threads 228 for mating engagement with internal threads 222 of counterbore 220, and the external threads 216 of collar surface 214 are formed for mating engagement with internal threads 230 of outer pipe 152.

The drill pipe assembly 150 may be formed from any of various suitable tubular goods materials such as iron, steel, aluminum and alloy combinations; however, one prototype presently being constructed is made from type 606IT6 aluminum. Also, the threads utilized for interconnection of the inner and outer pipes to the respective pin end and box end joints 156, 158 may be any type thread suitable for use in tubular goods, but a preferred specification is the 4 TPI Stub Acme type thread having no flank interference.

Figure 8:
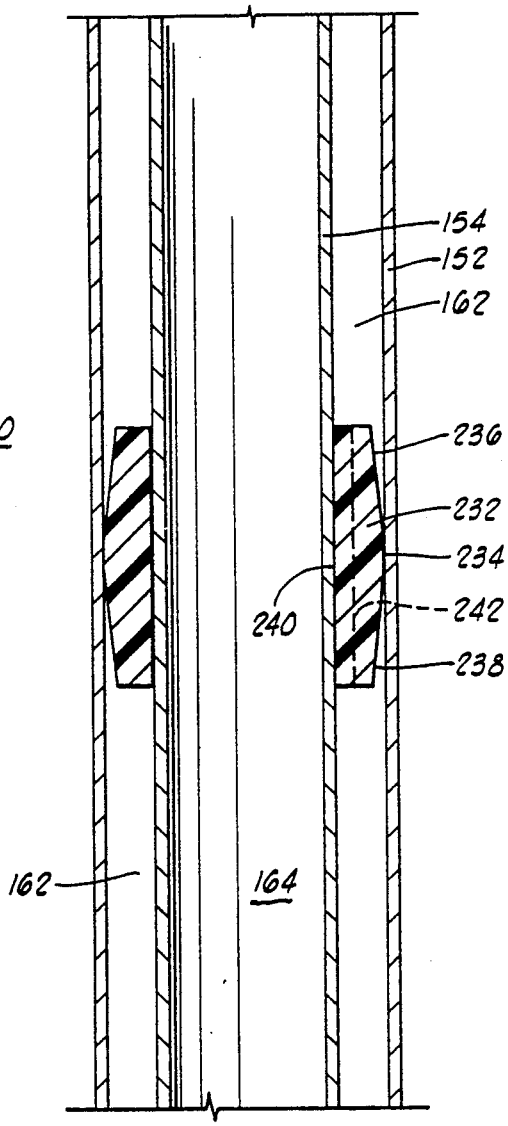
FIG. 8 is a view in vertical section of a portion of the drill pipe assembly with an equalizer positioned therein.

FIG. 8 illustrates an equalizer as utilized in the present invention. The equalizer 232 may be formed from such as urethane and consists of a central portion 234 that is the same thickness as the width of annular space 162 and tightly received therein. Equalizer 232 then tapers toward either side 236, 238 to allow for uninhibited flexure about the fulcral point. A small bore 242 may be formed through the width of equalizer 232 to permit air passage. In assembly, the equalizer 232 is bonded with inner cylindrical surface 240 secured to the outer surface of inner pipe 154 at a selected point along the length of the drill pipe assembly 150. Optimum placement would be for two equalizers 232 to be disposed about ten feet from each end of drill pipe assembly 150 and this would allow for 16° bend in 100 feet of drilled hole. This dimension may be adjusted and the equalizers 232 may each be moved centrally to gain flexure such that as much as 25° bend may be safely achieved per 100 feet of drilled hole.

The drill pipe assembly 150 is capable of being assembled in very secure manner. First, the equalizers 232 are bonded in position on inner pipe 154. Then, as shown in FIG. 7, the pen end joint 156 is threaded tightly onto the inner pipe 154 and the outer pipe 152 is threaded tightly thereover as it butts against the annular shoulder 212 of pin end joint 156. Thereafter, and referring to FIG. 6, the sleeve 160 is threadedly positioned on the inner pipe 154 and the external threads 188 of box end joint 158 are received within the internal threads 190 of the outer pipe 152. The threaded engagement continues until the internal threads 192 are received upon the external threads 194 of sleeve 160 until the terminus of outer pipe 152 abuts the annular shoulder 180. An expansible spanner wrench of conventional type is inserted end-wise through axial bore 174 into engagement with oppositely disposed lug holes 200 and 202 thereby to turn the sleeve 160 until it will assume tightest engagement. That is, lug adjustment of sleeve 160 should effect closure of sleeve 160 against annular shoulder 176 simultaneous with abutment of outer pipe 152 against annular shoulder 180.

Various of the utilitarian features of the drill pipe assembly 10 of FIGS. 1 through 5 may be included with the drill pipe assembly 150. Thus, the outer pipe 152 may include a check valve 24 and/or a removable access plug 30. Also, inter-pipe wire line access may be provided with joint ports and sealed feed-through between adjacent annular spaces. Finally, the turbulator 144 (FIGS. 4–5) may be employed along with external helical striations 132. The choice of addendum features would be dictated by the exigencies of the particular drilling operation and desired function of the drill pipe assembly.

The foregoing discloses a novel form of dual tube concentric drill pipe that includes an annular space that can function in any of several different ways to aid in a drilling operation, particularly in horizontal and greatly deviated well drilling applications. The annular space provided in the drill pipe assembly of the present invention can be charged or filled by selected liquids, gases or solids to derive attributes of buoyancy, increased weight, heat insulation, increased compressive strength, etc. In addition, the present dual pipe design enables the inclusion of continuous cable interconnection through the pipe annulus and respective pipe joints while electronic modules for sensing, amplification, transmitting and such can be safely positioned in the annular space.

Changes may be made in combination and arrangement of elements as heretofore set forth in the specification and shown in the drawings; it being understood that changes may be made in the embodiments disclosed without departing from the spirit and scope of the invention as defined in the following claims.

What is claimed is:

1. A drill pipe assembly comprising:

an outer pipe having first and second ends, each being internally threaded;

an inner pipe disposed within said outer pipe and defining an annular space, said inner pipe having first and second ends, each being externally threaded;

a pin end joint having the inner end formed as a lesser diameter collar having internal and external threads that tightly receive threaded connection between said outer pipe and inner pipe first ends;

a sleeve having internal and external threads which is threadedly received over the inner pipe second end;

a box end joint having the inner end formed as a lesser diameter collar having internal and external threads that tightly receive threaded connection between the outer pipe second end and said sleeve.

2. A drill pipe assembly as set forth in claim 1 which is further characterized to include:

at least one equalizer means disposed between said inner pipe and outer pipe to maintain said annular space.

3. A drill pipe assembly as set forth in claim 1 which is further characterized to include:

check valve means disposed in said outer pipe to allow air pressure charging of said annular space.

4. A drill pipe assembly as set forth in claim 1 which is further characterized to include:

a removable, sealed plug disposed in said outer pipe to allow placement of adjustment materials.

5. A drill pipe assembly as set forth in claim 1 which is further characterized to include:

cylindrical shoe means secured generally centrally on said outer pipe and carrying a plurality of helical paddle means for agitating and moving along fluid and particulate matter in the borehole.

6. A drill pipe assembly as set forth in claim 1 which is further characterized to include:

at least one spiral striation along said outer pipe for reducing differential surface tension therealong.

7. A drill pipe assembly as set forth in claim 5 wherein said cylindrical shoe means comprises:

first and second semi-cylindrical shoes each extending spiral ridge structure therealong.

8. A drill pipe assembly as set forth in claim 1 wherein:

the threads of the inner and outer pipes and mating sleeve and joint threads are Stub Acme type.

9. A drill pipe assembly as set forth in claim 2 wherein said equalizer means each comprise:

a cylindrical formation having a bore for bonding on said inner pipe at a preselected position and defining a central surface for contact with the outer pipe and surfaces tapering away from said contact on each side of the central surface.

10. A drill pipe assembly as set forth in claim 1 wherein said pin end joint further comprises:

a cylindrical body having pipe interconnecting threads formed on the outer end, and defining an upward facing annular shoulder that extends upward into said collar at the inner end.

11. A drill pipe assembly as set forth in claim 1 wherein said box end joint further comprises:

a cylindrical body having an axial bore with pipe interconnecting threads formed in the outer end, and defining a downward facing annular shoulder that extends downward into said collar at the inner end.

12. A drill pipe assembly as set forth in claim 1 wherein said sleeve further comprises:

first and second lug holes formed through opposite sides of said sleeve to allow rotation of the sleeve by manipulation through said box end joint.

13. A drill pipe assembly as set forth in claim 1 wherein:

the inner and outer pipes, pin end joint and box end joint are formed from aluminum.

14. A drill pipe assembly as set forth in claim 2 wherein:

at least the inner and outer pipes are formed from aluminum.

15. A drill pipe assembly as set forth in claim 2 wherein said at least one equalizer is further characterized to include:

an air passage formed generally parallel to the axis.

16. A drill pipe assembly as set forth in claim 5 wherein:

said cylindrical shoe means is molded from urethane.

* * * * *